US005729916A

United States Patent [19]

Vorobiev et al.

[11] Patent Number: 5,729,916

[45] Date of Patent: Mar. 24, 1998

[54] SHOE WITH ENERGY STORING SPRING HAVING OVERLOAD PROTECTION MECHANISM

[75] Inventors: Andrei Vorobiev, Chicago; David L. Brittingham, Bolingbrook, both of Ill.

[73] Assignee: Wilson Sporting Goods Co., Chicago, Ill.

[21] Appl. No.: 661,042

[22] Filed: Jun. 10, 1996

[51] Int. Cl.[6] ..... A43B 13/28; A43B 21/30; A43B 13/18

[52] U.S. Cl. ..... 36/27; 36/38; 36/28

[58] Field of Search ..... 36/35 R, 38, 34 R, 36/28, 27, 3 B, 29

[56] References Cited

U.S. PATENT DOCUMENTS

| | | | |
|---|---|---|---|
| 4,573,279 | 3/1986 | Feurer-Zogel et al. | 36/35 R |
| 4,598,487 | 7/1986 | Misevich | 36/28 X |
| 4,782,603 | 11/1988 | Brown | 36/29 |
| 4,864,738 | 9/1989 | Horovitz | 36/29 |
| 4,881,329 | 11/1989 | Crowley | 36/38 |
| 4,910,884 | 3/1990 | Lindh et al. | 36/27 X |
| 5,060,401 | 10/1991 | Whatley | 36/25 R |
| 5,068,981 | 12/1991 | Jung | 36/38 X |
| 5,070,629 | 12/1991 | Graham et al. | 36/27 |
| 5,279,051 | 1/1994 | Whatley | 36/25 R |
| 5,628,128 | 5/1997 | Miller et al. | 36/28 |

FOREIGN PATENT DOCUMENTS

| | | | |
|---|---|---|---|
| 2448308 | 10/1980 | France | 36/28 |
| 2243530 | 11/1991 | United Kingdom | 36/28 |

*Primary Examiner*—B. Dayoan

[57] ABSTRACT

A shoe is provided with a spring mechanism in the heel area. The spring includes a pair of generally circular end portions which are supported by the outsole and a beam portion which extends between the end portions. Initial impact cushioning is provided by resilient deflection of the end portions and compression of surrounding materials. The main cushioning is provided by linear deflection of the beam portion. Overload protection is provided by restorable collapsing of the cross section of the beam.

17 Claims, 4 Drawing Sheets

SHOE WITH ENERGY STORING SPRING HAVING OVERLOAD PROTECTION MECHANISM

BACKGROUND

The invention relates to footwear, and, more particularly, to a shoe for high load repetitive locomotion such as sports activities.

Various attempts have been made to increase biomechanical efficiency of the foot-surface interaction. The problem is the tradeoff between shock absorption and energy return requirements to the shoe. A shoe designed to produce higher energy return is generally stiffer. However, a stiffer shoe produces more stress to the locomotor system and increases the risk of the injury.

SUMMARY OF THE INVENTION

The invention provides a biomechanically preferred cushioning system with an overload protection. The inventive mechanism increases the amount of stored energy from the heel strike and reduces the energy lost during the foot-surface event when the acting forces are within the safe loading range for the body. At the same time, the mechanism dissipates the excess energy more efficiently when the forces exceed biomechanically safe limits.

The mechanism consists of a loading beam with two end supports. The loading beam has a generally circular shape in cross section. The supports also have a generally circular shape with bottom surfaces which are flattened and have low curvature for stable positioning on top of the outsole and which provide an anti-rotation function when horizontal shear forces are applied. The stiffness of the end supports is selected to withhold the forces from the loading beam bending.

Initial impact cushioning of preloading phase is provided by resilient flattening of the low curvature bottom surfaces of the end supports, compression of the foam placed between the heel and the beam, as well as other surrounding materials. During the initial impact the flattening of the support surfaces, foam deflection, and interlayer friction act as a high frequency mechanical filter reducing shock waves coming from impact.

In the main loading phase of heel ground interaction the primary cushioning is provided by linear deflection of the loading beam. The characteristics of the loading beam are selected to provide linear elasticity with high mechanical efficiency within the safe physiological loading range. During this phase a minor deformation of the end supports is occurring. This phase is defined as the major load bearing condition of heel strike.

The phase of overloading is defined when the safe physiological limit is exceeded and the beam rapidly loses stiffness due to restorable collapsing of the beam cross-section. The excess impact energy is dissipated by the secondary deflection and shear layering of the beam top and bottom surfaces, end supports and subsequent loading of foams.

The end supports extend upwardly above the beam and provide stability for foot over-pronation and over-supination. The enlarged conical shape of the end supports reduces lateral shear movement in the rear portion of the shoe which increases the performance stability of the shoe. Under bending conditions, the upper portion of the end supports move towards each other. The changing geometry guides and positions the foot in the center of the shoe. This enhances heel fit and provides additional lateral stability.

For additional sustenance the end supports and/or hollow loading beam of the spring member can be partially or fully filled with foam or any other material. This will slightly increase the overall shoe stiffness and make the process of beam collapsing less rapid.

DESCRIPTION OF THE DRAWING

The invention will be explained in conjunction with an illustrative embodiment shown in the accompanying drawings, in which.

DESCRIPTION OF SPECIFIC EMBODIMENT

Figure 1:
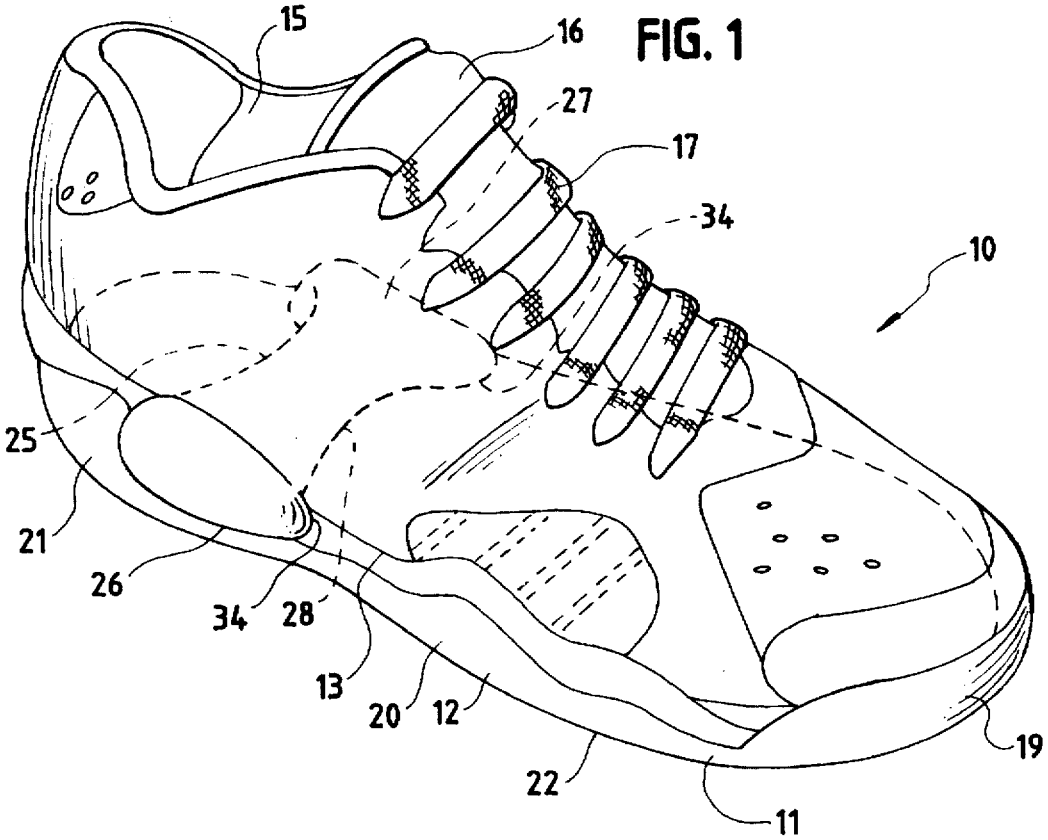
FIG. 1 is a perspective view, partially broken away, of a shoe which is provided with an energy storing spring in accordance with the invention.
Figure 2:
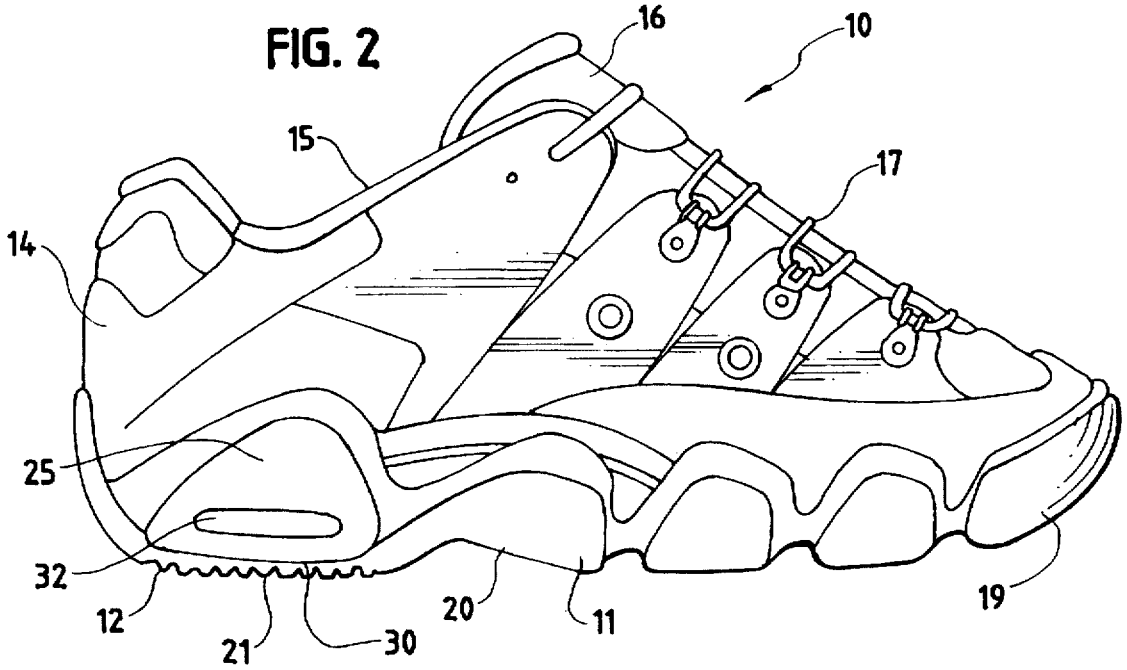
FIG. 2 is a lateral side view of the shoe.

A shoe 10 includes a sole 11 comprising an outsole 12 and a midsole 13, and an upper 14. The upper includes a conventional foot opening 15, tongue 16, and shoelace 17.

The sole includes a toe portion 19, an instep portion 20, and a heel portion 21. The particular shoe illustrated is for the right foot, and the sole includes a lateral or right side 22 and a medial or left side 23 (FIG. 4).

A spring cushioning member 25 is supported by the heel portion of the sole. The spring includes a pair of generally conical end portions 26 and 27 and a tubular beam portion 28 which extends between the ends generally transversely to the longitudinal centerline CL (FIG. 4) of the shoe.

Figure 3:
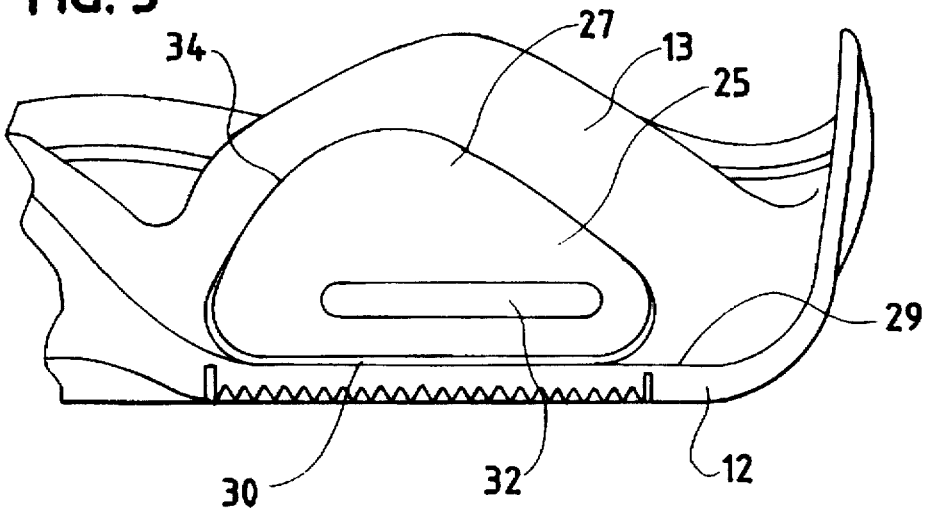
FIG. 3 is a fragmentary medial side elevational view of the outsole and midsole of the shoe.
Figure 4:
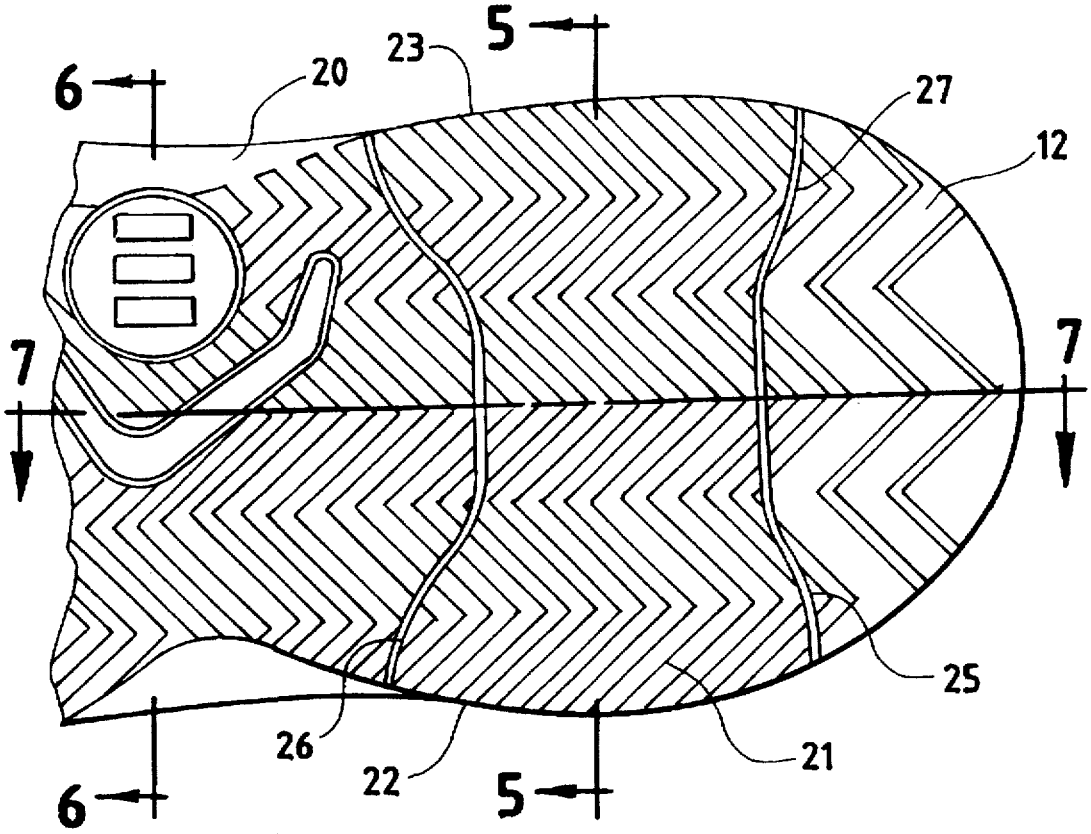
FIG. 4 is a fragmentary bottom plan view of the outsole and midsole.
Figure 7:
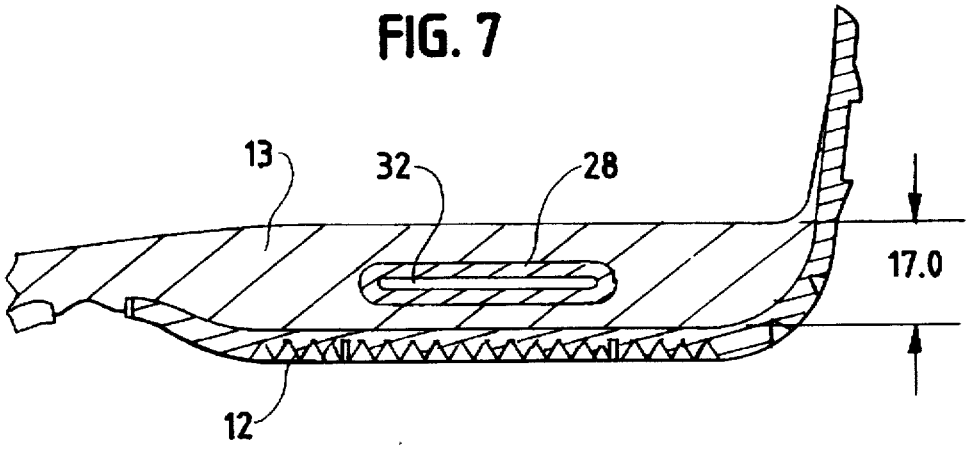
FIG. 7 is a sectional view taken along the line 7—7 of FIG. 4.

Referring to FIGS. 3, 4, and 7, the end portions 26 and 27 of the spring are supported by the upper surface 29 of the outsole 12. Each end portion includes a flattened bottom support surface 30 which engages the outsole and resists rotation of the spring. The outsole is advantageously formed from rubber, although other conventional sole materials can be used.

The beam portion 28 of the spring is spaced upwardly from the outsole by the end portions. The midsole 13 surrounds the beam and extends between the beam and the outsole. The midsole is advantageously formed from EVA foam, but other materials can be used. The tubular beam has a generally annular cross section (FIG. 7) and a central bore 32 which extends between the end portions transversely to the longitudinal centerline CL.

Figure 5:
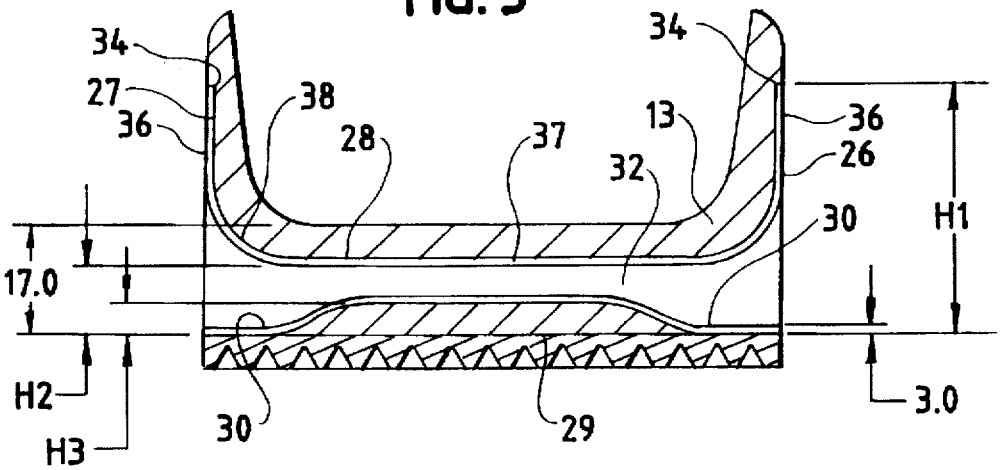
FIG. 5 is a sectional view taken along the line 5—5 of FIG. 4.
Figure 6:
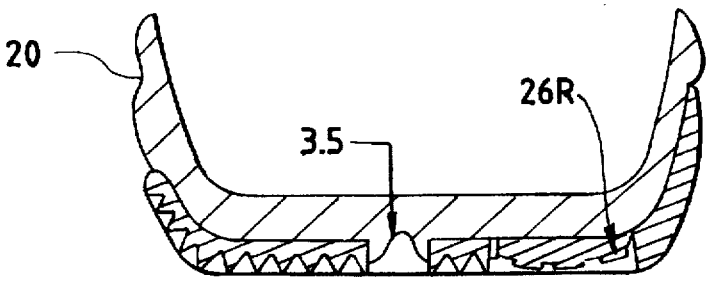
FIG. 6 is a sectional view taken along the line 6—6 of FIG. 4.

The conical end portions 26 and 27 flare radially outwardly from the beam. Each end portion has a generally circular outer edge 34 which defines a funnel-shaped opening which communicates with the bore 32 of the beam. The upper portion 36 of each end portion extends upwardly above the upper surface 37 of the beam. The conical end portions and the beam provide the spring with a generally concave top surface 38 (FIG. 5) in a vertical cross section which extends through the central axis of the bore 32.

The spring is integrally formed from material which will resiliently deflect under loads which are normally applied by a foot. One specific example was formed from Nylon 11. However, other materials are also suitable. For example, stiffer materials such as metal and composites formed from polymers and fibers can be used. Suitable fibers are carbon, aramid, synthetics, and ceramics. Stiff materials such as metal and composites have low hysteresis and therefore very low energy loss during deflection and provide highly efficient locomotion. Flexible elastomers and thermoplastic rubbers may also be applied to the beam or used to manufacture a beam or any portion of the beam to cushion stiffer materials.

When the shoe contacts a support surface, flattening of the end portions 26 and 27 and the compression of the foam layer 13 and other materials above the spring and under the end supports 26, 27 and also tightening up the tolerances and initial deflection of the loading beam 28 provide initial impact cushioning and high frequency filtering. As the load increases, the main cushioning is provided by linear deflection of the beam 28 and partially by compression of the foam 13 under the beam. The compressibility of the foam placed under the beam and the outsole allows the beam to bend downwardly toward the outsole.

The linear deflection of the loading beam is sufficient to cushion the impact of most loads. However, under high load conditions the spring provides overload protection. Under high loading, the annular cross section of the beam collapses and flattens. The main cushioning in this case is provided by further compression of the surrounding foams and interlayer friction. If more gradual stiffness variation is desired, the hollow spring element can be filed with foam or any other material.

The resilient material of the spring allows the spring to return to its original configuration when the load is removed.

Figure 8:
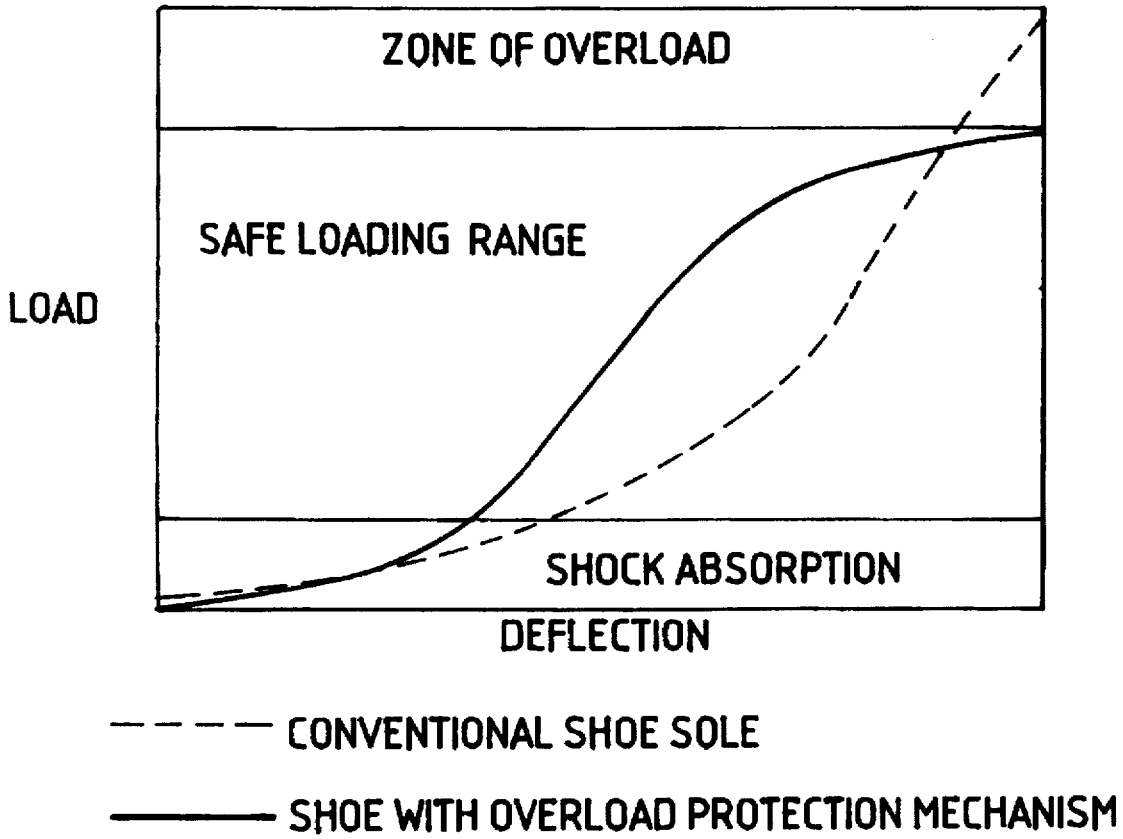
FIG. 8 is a load deflection diagram comparing a conventional sole and a sole formed in accordance with the invention.

FIG. 8 illustrates load deflection curves for a conventional sole (dashed line) and a sole with an overload protection spring 25 (solid line). The area under the curves in FIG. 8 reflects the amount of stored energy in both cases. The area under the solid line is greater than the dashed line and indicates a higher restorable energy capacity within the safe loading range for shoe with a beam spring mechanism. When operating the spring within the safe physiological range, more energy is conserved and stored. The sole with the spring is stiffer than a conventional sole under normal loads (deflection is less). However, when the load exceeds the safe loading range indicated by the upper horizontal line, the sole with the spring is softer than the conventional sole and provides overload cushioning protection by virtue of the collapse of the beam cross section.

The spring also stabilizes the foot and prevents over-pronation and over-supination. The concave upper surface of the spring extends upwardly on the lateral and medial sides of the heel. As the beam deflects downwardly, the upper surface of the beam curves downwardly and tends to center the heel within the spring and tightens the heel fit. The centering and tightening forces increase when the beam deflects, and the upper ends of the end portions move toward each other. The changing geometry of the spring guides and positions the foot in the longitudinal center of the shoe, preventing inversion.

The enlarged conical shape of the end portions of the spring reduces lateral shear movement in the shoe and increases the performance stability of the shoe. The flattened support surfaces of the end portions prevent rotation of the spring when longitudinal shear forces are applied.

In one specific embodiment of the spring the height $H_1$ (FIG. 5) of the end portions was 37.0 mm, the height $H_2$ of the beam above the outsole was 11.0 mm, and the space between the beam and the outsole was 5.0 mm. The height $H_3$ of the beam was 6.0 mm. The wall thickness of the spring was 2.5 mm.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A shoe comprising a sole having a bottom surface, lateral and medial sides, a toe portion, an instep portion, and a heel portion, an upper attached to the sole, a spring member supported by the heel portion of the sole, the spring member having a pair of generally conical end portions which are positioned adjacent the sides of the sole and a tubular beam portion which extends between the end portions, each of the end portions having a bottom portion which extends below the beam portion, the beam portion being resiliently bendable downwardly toward the bottom surface of the sole.

2. The shoe of claim 1 in which the end portions of the spring member have low curvature and are resiliently deflectable in a preloading phase during which said bottom portion of each of said end portions becomes flat.

3. The shoe of claim 1 in which the spring member is integrally formed.

4. The shoe of claim 3 in which the spring member is nylon.

5. The shoe of claim 1 in which the end portions of the spring member extend upwardly above the beam portion.

6. The shoe of claim 1 with a foam material below the beam portion.

7. The shoe of claim 6 in which the foam material is EVA.

8. The shoe of claim 1 in which each of the end portions of the spring member is generally circular in cross-section.

9. The shoe of claim 1 in which the beam portion is generally annular in cross section.

10. The shoe of claim 1 in which each of the end portions of the spring member is generally circular and has a central opening and the beam portion is generally annular in cross section and has a central bore which communicates with the openings in the end portions.

11. The shoe of claim 10 in which the spring member is integrally formed.

12. The shoe of claim 11 in which the end portions of the spring member extend upwardly above the beam portion.

13. The shoe of claim 12 including foam material below the beam portion.

14. The shoe of claim 10 in which the beam portion includes an upper surface which is generally concave in a direction along the central bore of the beam portion.

15. The shoe of claim 1 in which the beam portion has an upper surface which is generally concave in a cross section which extends between the end portions.

16. The shoe of claim 1 in which the end portions of the spring member contains foam to provide more gradual stiffness changing of the loading beam during beam bending.

17. The shoe of claim 1 in which the beam contains foam to provide more gradual stiffness changing of the loading beam during beam bending.

* * * * *